US011796257B2

(12) United States Patent
Omur et al.

(10) Patent No.: US 11,796,257 B2
(45) Date of Patent: Oct. 24, 2023

(54) AMMONIA FILLING SYSTEM

(71) Applicants: TUSAS—TURK HAVACILIK VE UZAY SANAYII ANONIM SIRKETI, Ankara (TR); GAZI UNIVERSITESI, Ankara (TR)

(72) Inventors: Cem Omur, Kazan/Ankara (TR); Ahmet Bilge Uygur, Kazan/Ankara (TR); Hasan Gurguc Isik, Kazan/Ankara (TR); Ilhami Horuz, Ankara (TR)

(73) Assignee: TUSAS—TURK HAVACILIK VE UZAY SANAYII ANONIM SIRKETI, Ankara (TR)

( * ) Notice: Subject to any disclaimer, the term of this patent is extended or adjusted under 35 U.S.C. 154(b) by 743 days.

(21) Appl. No.: 16/969,281

(22) PCT Filed: Feb. 12, 2019

(86) PCT No.: PCT/TR2019/050089
§ 371 (c)(1),
(2) Date: Aug. 12, 2020

(87) PCT Pub. No.: WO2019/160518
PCT Pub. Date: Aug. 22, 2019

(65) Prior Publication Data

US 2021/0010756 A1 Jan. 14, 2021

(30) Foreign Application Priority Data

Feb. 14, 2018 (TR) ..... 2018/02075

(51) Int. Cl.
*F28D 15/02* (2006.01)
*F28D 15/06* (2006.01)

(52) U.S. Cl.
CPC ..... *F28D 15/0283* (2013.01); *F28D 15/06* (2013.01); *F28D 15/0241* (2013.01); *F28D 15/0266* (2013.01)

(58) Field of Classification Search
CPC .. F28D 15/0283; F28D 15/06; F28D 15/0241; F28D 15/0266
See application file for complete search history.

(56) References Cited

U.S. PATENT DOCUMENTS 4,881,580 A 11/1989 Murphy et al.
2006/0150647 A1 7/2006 Li
(Continued)

FOREIGN PATENT DOCUMENTS

EP 2395309 A1 12/2011
SU 885748 A1 11/1981

OTHER PUBLICATIONS

International Search Report and Written Opinion for corresponding PCT application No. PCT /TR2019/050089, dated Mar. 3, 2020.
(Continued)

*Primary Examiner* — Jason K Niesz
(74) *Attorney, Agent, or Firm* — Notaro, Michalos & Zaccaria P.C.

(57) ABSTRACT

A filling system that has a chamber, at least one heat pipe used for heat transfer and extending along the chamber, at least one ammonia tube that pure ammonia is able to be stored at room temperature as saturated vapour, at least one delivery line that enables to deliver ammonia from the ammonia tube to the heat pipe and the heat pipe is removably engaged, at least one valve is located on the delivery line and allows ammonia flow to controlled, at least one detector located on the delivery line and providing seal control, at least one heater to heat the heat pipe, and at least one cooler to cool the heat pipe.

13 Claims, 3 Drawing Sheets

(56) References Cited

U.S. PATENT DOCUMENTS

| | | | | |
|---|---|---|---|---|
| 2006/0254668 | A1* | 11/2006 | Lin | F28D 15/0283 141/59 |
| 2012/0011720 | A1* | 1/2012 | Lin | F28D 15/04 29/890.032 |
| 2013/0111756 | A1* | 5/2013 | Jouhara | F28D 15/0283 29/890.032 |
| 2017/0356319 | A1 | 12/2017 | Zhang | |

OTHER PUBLICATIONS

International Preliminary Report on Patentability for corresponding PCT application No. PCT /TR2019/050089, dated Aug. 6, 2020.

* cited by examiner

AMMONIA FILLING SYSTEM

RELATED TECHNICAL FIELD

The present invention relates to a filling system enabling to fill the heat pipes, which are utilized at space crafts and/or aircrafts for heat transfer, with ammonia.

BACKGROUND OF THE INVENTION

Heat pipes are utilized at space crafts and/or aircrafts in order to transfer heat formed. In these heat pipes, heat delivery is performed by means of a fluid, wherein ammonia is the main fluid among such fluids. Operation of filling the heat pipes utilized for heat transfer at the space crafts and/or aircrafts with the ammonia is performed with high precision. Ammonia amount in the heat pipes affects heat transfer which is enabled by the heat pipes. Therefore, it is important to perform operation of filling the heat pipes with ammonia both in a precise and an energy-saving way.

Such an exemplary filling system is disclosed in published U.S. Pat. No. 4,881,580A, wherein said document mentions a system which performs both filling and discharge operations for heat pipes and similar closed carriers. Here, water, ammonia, alcohol, and halogen hydrocarbons may be used inside the heat pipe as a pure fluid. The pure fluid chosen in appropriate amounts is controllably filled into the heat pipe via valves. However, it is not possible to provide high precision filling operation required for the space crafts and/or aircrafts and to obtain desired energy efficiency during a filling operation.

BRIEF DESCRIPTION OF INVENTION

The filling system according to the present invention comprises a chamber, at least one heat pipe extending in and along the chamber and used for heat transfer, at least one ammonia tube in which pure ammonia is able to be stored at room temperature as saturated vapour, at least one delivery line which enables to transfer ammonia from the ammonia tube to the heat pipe and to which the heat pipe is removably engaged, at least one valve which is located on the delivery line and allows ammonia flow to be performed controllably, at least one detector located on the delivery line and used for vacuuming and/or sealing assessment, and at least one heater to increase temperature of the heat pipe, at least one cooler to cool the heat pipe.

The filling system according to the invention comprises at least one additional heater to keep an end area of the heat pipe which is connected with the delivery line above a predetermined temperature value.

In another embodiment of the invention the filling system has an additional heater which provides heat to an area of the heat pipe which is connected with the delivery line, while the heat pipe is cooled. While filling the heat pipe with ammonia, the heat pipe is cooled by the cooler. This provides to liquefy the ammonia inside the heat pipe and to fill the heat pipe with ammonia. While the heat pipe is being cooled, heat is provided by the additional heater to an end of the heat pipe where ammonia introduction occurs. During an operation of filling the heat pipe with ammonia, ammonia is prevented from being liquefied at the end of the heat pipe where ammonia introduction occurs. This provides to fill the heat pipe with ammonia in a more effective manner.

In another embodiment of the invention, the filling system has an additional heater to inject hot air. The additional heater injects hot air to the connection area of the heat pipe and the delivery line. This enables to keep a temperature value of said area above a predetermined temperature value in a simple and effective way.

In another embodiment of the invention, the filling system comprises the steps of conducting a sealing assessment for the heat pipe by the detector, filling the heat pipe by the delivery line with a predetermined amount of ammonia from the ammonia tube, increasing a temperature of the heat pipe by the heater, performing a seal control by the detector while ammonia inside the heat pipe is removed from the heat pipe by being vacuumed, loading ammonia from the ammonia tube to the heat pipe by the delivery line, cooling the heat pipe by the cooler in order to liquefy ammonia inside the heat pipe, and providing heat by the additional heater to an end of the heat pipe which is connected with the delivery line during an operation of cooling the heat pipe.

In an embodiment of the invention, the filling system comprises a connection member having a tube-fitting connection feature which enables to connect the heat pipe and the delivery line. Preferably, cylindrical connections are firmly connected to each other via a ferrule tightened by a nut. Thanks to this, sealing is safely provided at the connection points under high pressure values. Therefore, filling heat pipes with ammonia is performed in a more effective manner.

In another embodiment of the invention, the filling system has an additional heater to keep a temperature of the connection member above a predetermined certain temperature value. This prevents ammonia from being liquefied at the connection area, thereby allowing filling the heat pipe with ammonia in an effective manner.

In another embodiment of the invention, the filling system comprises a cooler to cool the heat pipe locally from an end of the heat pipe towards the connection of heat pipe and delivery line. The cooler cools the ammonia inside the heat pipe to turn ammonia into a liquid phase. The heat pipe is started to be cooled at a point away from the connection of heat pipe and delivery line. Before filling the heat pipe with ammonia, ammonia is prevented from being liquefied at the connection of heat pipe and the delivery line. This allows filling the heat pipe with ammonia in an effective manner.

In another embodiment of the invention, the cooler is dry ice which is the solid phase of the carbon dioxide.

In another embodiment of the invention, the filling system comprises a valve located on the heat pipe or the delivery line and allowing ammonia transfer or removal into and from the heat pipe, and at least one weight measuring device to measure weight of the heat pipe. By measuring the weight, it is detected whether the heat pipe is filled in desired amounts or not. If too much ammonia is present in the heat pipe, it is sent out by the valve, or if an insufficient amount of ammonia is present in the heat pipe, ammonia is added to the heat pipe by the valve.

In another embodiment of the invention, the filling system comprises at least one heat meter located on the delivery line or the heat pipe and measuring a temperature, and at least one regulator located on the ammonia tube or the delivery line and enabling to deliver predetermined amounts of ammonia from the ammonia tube to the delivery line. This provides to fill the heat pipe with ammonia controllably.

In another embodiment of the invention, the filling system comprises a control unit to control operation of the valve via weight data. This provides to fill the heat pipe with ammonia controllably.

In another embodiment of the invention, the filling system has a control unit to adjust operation of the regulator depending on the temperature information. Depending on the temperature data, ammonia flow rate to be delivered from the regulator to the delivery line is adjusted.

In an embodiment of the invention, the heat pipe is utilized at the space crafts and/or aircrafts for heat transfer. Heat transfer is performed with high precision at space crafts and/or aircrafts. Thanks to the filling system, the heat pipe is filled with ammonia in an effective manner with high precision.

The filling system according to the present invention enables to fill the heat pipes with ammonia without disturbing degree of purity of the ammonia gas. Moreover, a single system is able to perform both filling and gas emission operations, thereby reducing the manufacturing costs. In addition, the system and method according to the invention is able to fill the heat pipes with ammonia, being in the gas phase at room conditions, in desired amounts.

OBJECT OF INVENTION

An object of the present invention is to provide a filling system which enables to fill the heat pipes provided at space crafts and/or aircrafts with ammonia.

Another object of the present invention is to provide a filling system which enables to fill the heat pipes with pure ammonia gas without disturbing degree of purity thereof;

A further object of the present invention is to provide a low-cost filling system which enables to fill the heat pipes with ammonia gas, which is in gas phase at room conditions, in desired amounts.

Yet another object of the present invention is to provide a filling system to keep heat transfer capacity of the heat pipes at a desired level.

DESCRIPTION OF DRAWINGS

The filling system realized to achieve the object of the present invention is illustrated in attached drawings, in which.

Figure 1:
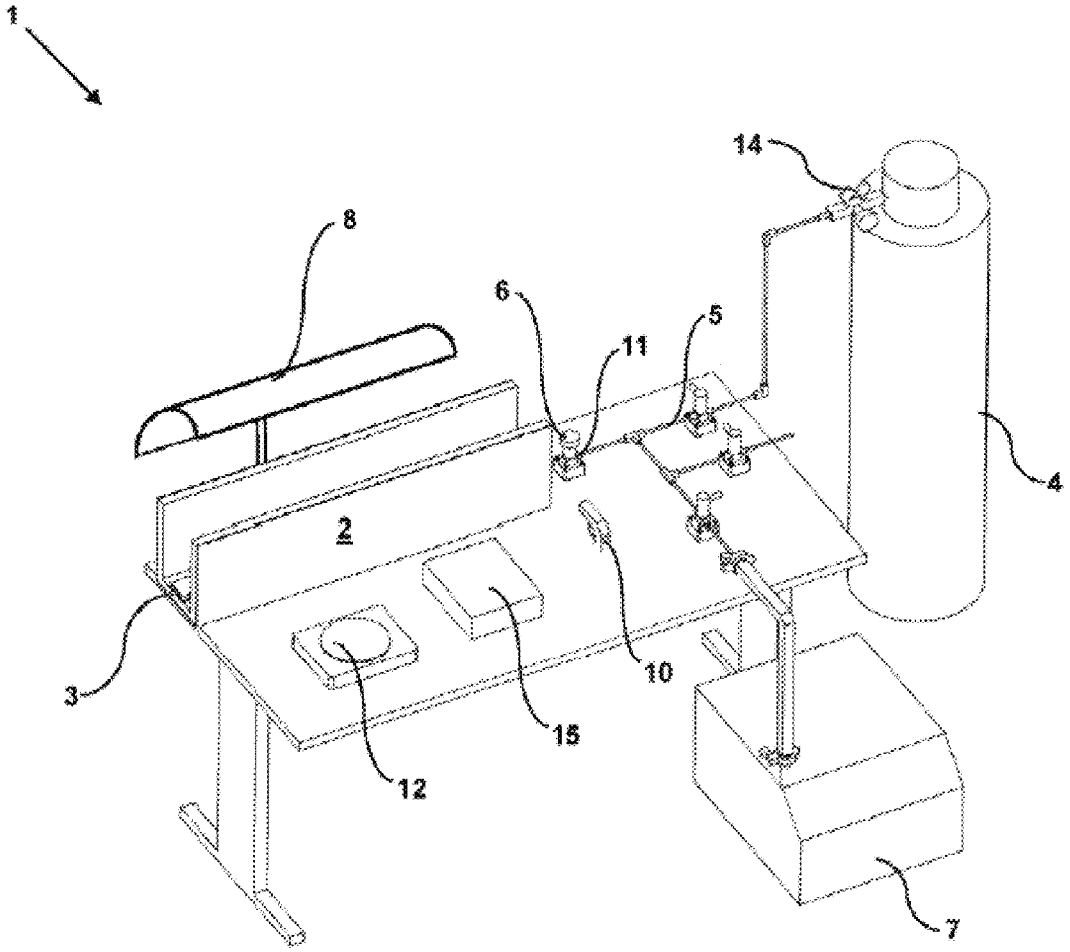
FIG. 1—is a perspective view of a filling system.

All the parts illustrated in the drawings are individually assigned a reference numeral and the corresponding terms of these numbers are listed as follows:

1. Filling System
2. Chamber
3. Heat Pipe
4. Ammonia Tube
5. Delivery Line
6. Valve
7. Detector
8. Heater
9. Cooler
10. Additional Heater
11. Connection Member
12. Weight Measuring Device
13. Heat Meter
14. Regulator
15. Control Unit

DESCRIPTION OF INVENTION

The filling system (1) comprises a chamber (2), at least one heat pipe (3) used for heat transfer and extending along the chamber (2), at least one ammonia tube (4) in which pure ammonia is able to be stored at room temperature as saturated vapour, at least one delivery line (5) which enables to deliver ammonia from the ammonia tube (4) to the heat pipe (3) and to which the heat pipe (3) is removably engaged, at least one valve (6) which is located on the delivery line (5) and allows ammonia flow to controlled, at least one detector (7) located on the delivery line (5) and providing seal control, at least one heater (8) to heat the heat pipe (3), and at least one cooler (9) to cool the heat pipe (3).

Figure 2:
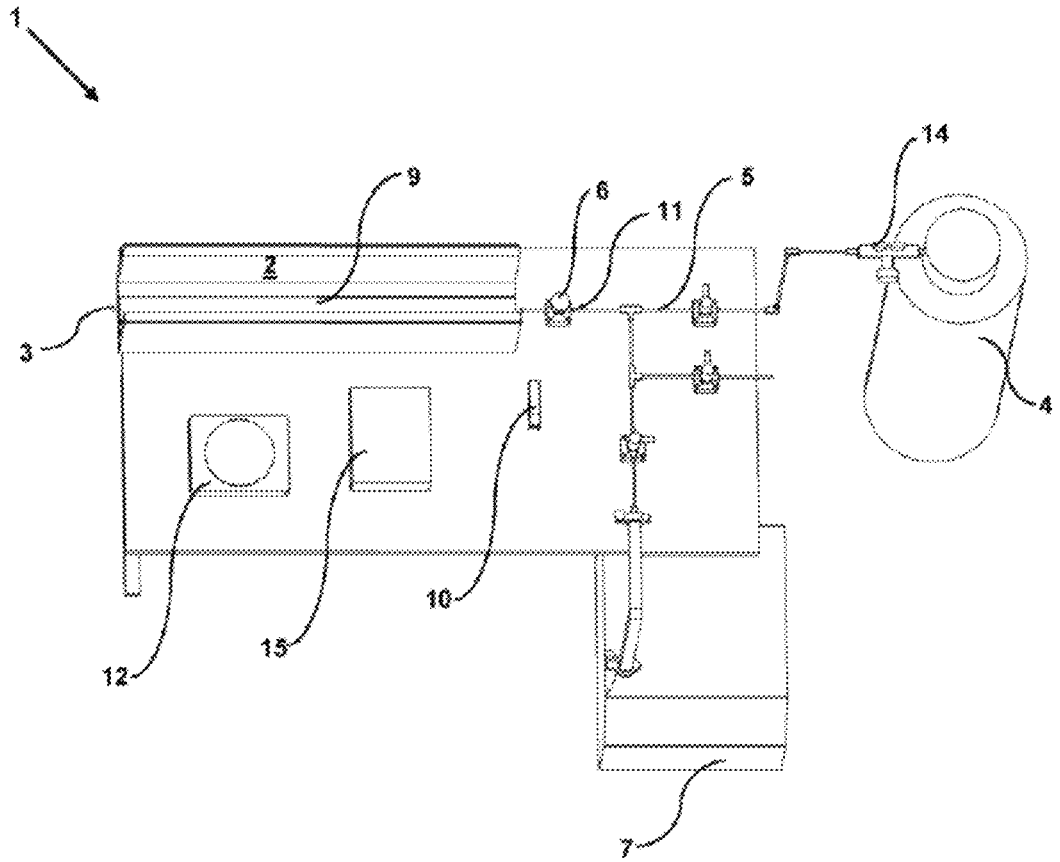
FIG. 2—is a top perspective view of the filling system.

The filling system (1) of the present invention comprises at least one additional heater (10) to keep an end of the heat pipe (5) which is connected with the delivery line (5) above a predetermined temperature value (FIG. 1 and FIG. 2).

The filling system (1) of the present invention delivers the ammonia from the ammonia tube (4), in which the ammonia almost in the gas phase is present, to the delivery line (5). The ammonia is able to be controllably delivered from the delivery line (5) to the heat pipe (3) by at least one valve (6). Being delivered almost in the gas phase into the heat pipe (3), the ammonia is liquefied in the heat pipe (3) upon cooling the heat pipe (3), thereby performing operation of filling the heat pipe (3) with ammonia. In order to be able to introduce ammonia to the heat pipe (3) properly, an end of the heat pipe (3) where ammonia introduction occurs is heated by the additional heater (10). This avoids an ammonia-originated blockage at the end of the heat pipe (3) being connected with the delivery line (5) and where ammonia introduction occurs. Therefore, the heat pipe (3) is filled with ammonia in an effective manner.

In another embodiment of the invention, the filling system (1) has an additional heater (10) which provides heat to an end of the heat pipe (3) which is connected with the delivery line (5), while the heat pipe (3) is cooled. While filling the heat pipe (3) with ammonia, the heat pipe (3) is cooled by the cooler (9). This provides to liquefy the ammonia inside the heat pipe (3) and to fill the heat pipe (3) with ammonia. While the heat pipe (3) is cooled, an end of the heat pipe (3) where ammonia introduction occurs is heated by the additional heater (10). During an operation of filling the heat pipe (3) with ammonia, ammonia is prevented from being liquefied at the end of the heat pipe (3) where ammonia introduction occurs. This provides to fill the heat pipe (3) with ammonia in a more effective manner.

In another embodiment of the invention the filling system (1) has an additional heater (10) to blow hot air. The additional heater (10) blows hot air to the connection area of the heat pipe (3) and the delivery line (5). This enables to keep a temperature value of said area above a predetermined temperature value in a simple and effective way.

In another embodiment of the invention, the filling system (1) comprises a detector (7) to perform seal control while the heat pipe (3) is heated by the heater (8), and a cooler (9) to cool heat pipe (3) in order to liquefy ammonia inside the heat pipe (3) while the heat pipe (3) is filled with ammonia. The operation method (M) of the filling system (1) comprises the steps of performing a seal control for the heat pipe (3) by the detector (7), filling the heat pipe (3) by the delivery line (5) with a predetermined amount of ammonia from the ammonia tube (4), heating the heat pipe (3) by the heater (8), performing a seal control by the detector (7) while ammonia inside the heat pipe (3) is removed from the heat pipe (3) by being vacuumed, filling the heat pipe (3) with ammonia from the ammonia tube (4) by the delivery line (5), cooling the heat pipe (3) by the cooler (9) in order to liquefy ammonia inside the heat pipe (3) while the heat pipe (3) is filled with ammonia, and heating an end of the heat pipe (3) by the additional heater (10) during an operation of cooling the heat pipe (3). Preferably by the detector (7) which is able to detect helium gas, the delivery line (5) and the heat pipe (3)

is filled preferably with the helium gas to provide seal control by the detector (7). After the seal control, ammonia gas of a predetermined amount is transferred to the heat pipe (3). By heating the heat pipe (3) via the heater (8), ammonia inside the heat pipe (3) is almost turned into a gas phase and vacuumed to be sent out. While said ammonia is vacuumed from the heat pipe (3), sealing control is repeated by the detector (7). In case no leakage is detected, the heat pipe (3) is filled with ammonia from the ammonia tube (4) by the delivery line (5). The heat pipe (3) is cooled to liquefy the ammonia inside the heat pipe (3). In order not to liquefy ammonia while introducing ammonia to the heat pipe (3), an end of the heat pipe (3) which is connected with the delivery line (5) is heated by the additional heater (10). This provides to fill the heat pipe (3) with ammonia in an effective manner.

In an embodiment of the invention, the filling system (1) comprises a connection member (11) having a tube-fitting connection feature which enables to connect the heat pipe (3) and the delivery line (5). Preferably, tubular connections are firmly connected to each other via a ferrule tightened by a nut such that there is no leakage. Thanks to this, sealing is safely provided at the connection points under high pressure values. Therefore, filling heat pipes (3) with ammonia is performed in a more effective manner.

In another embodiment of the invention, the filling system (1) has an additional heater (10) to keep a temperature of the connection member (11) above a predetermined temperature value. This prevents ammonia from being liquefied at the connection area, thereby allowing filling the heat pipe (3) with ammonia in an effective manner.

In another embodiment of the invention, the filling system (1) comprises a cooler (9) to cool the heat pipe (3) gradually from an end of the heat pipe (3) towards the connection of heat pipe (3) and delivery line (5). The cooler (9) cools the ammonia inside the heat pipe (3) to turn ammonia into a liquid phase. The heat pipe (3) is started to be cooled at a point away from the connection of heat pipe (3) and delivery line (5). Before filling the heat pipe (3) with ammonia, ammonia is prevented from being liquefied at the connection of the heat pipe (3) and the delivery line (5). This allows filling the heat pipe (3) with ammonia in an effective manner.

In another embodiment of the invention, the cooler (9) is dry ice. This enables to cool a desired area or full area of the heat pipe (2).

In another embodiment of the invention, the filling system (1) comprises a valve (6) located on the heat pipe (3) or the delivery line (5) and allowing ammonia transfer or removal into and from the heat pipe (3), and at least one weight measuring device (12) to measure weight of the heat pipe (3). By measuring the weight, it is detected whether the heat pipe (3) is filled in desired amounts or not. If too much ammonia is present in the heat pipe (3), it is sent out by the valve (6), or if an insufficient amount of ammonia is present in the heat pipe (3), ammonia is added to the heat pipe (3) by the valve (6).

Figure 3:
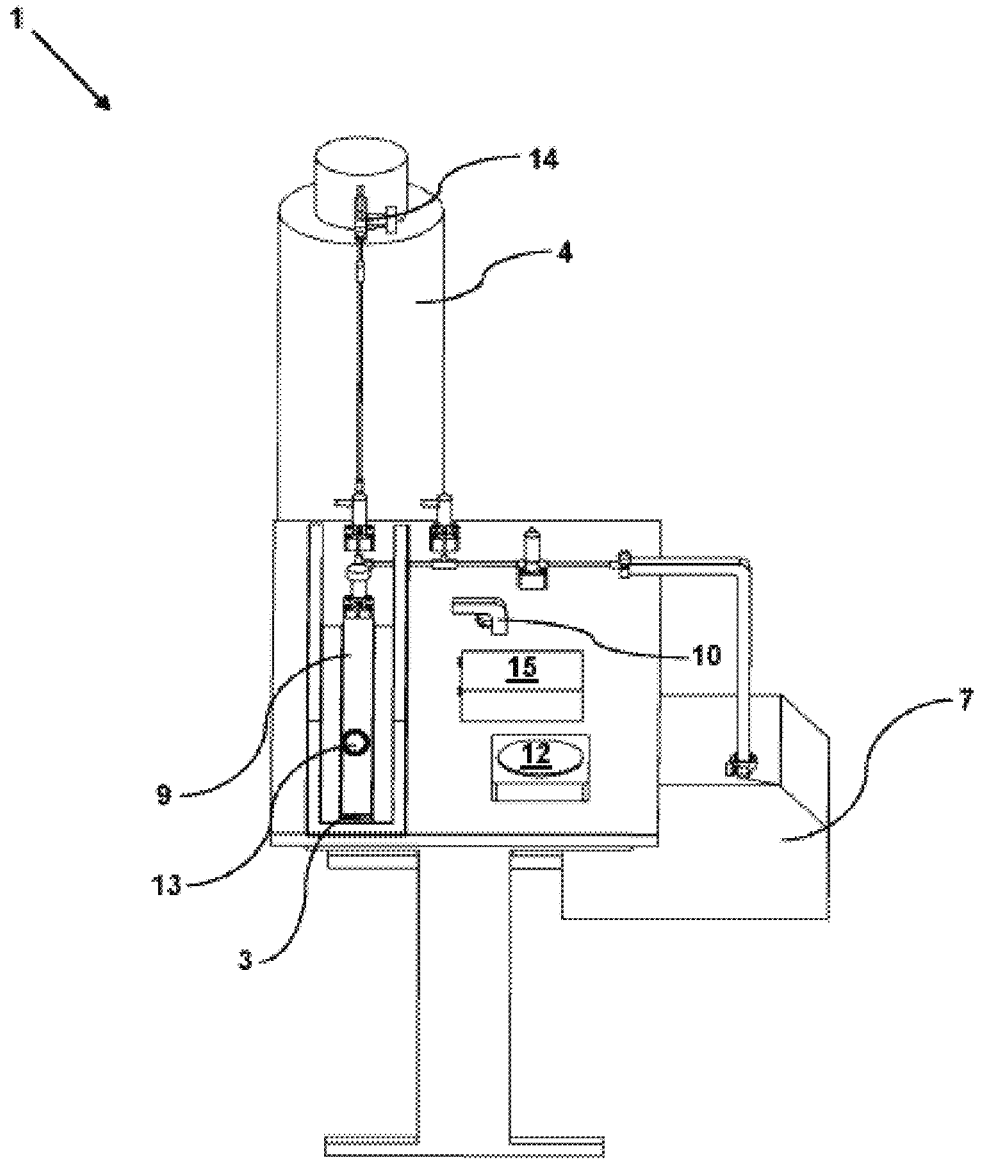
FIG. 3—is a view of the heat meter and the regulator.

In another embodiment of the invention, the filling system (1) comprises at least one heat meter (13) located on the delivery line (5) or the heat pipe (3) and measuring a temperature, and at least one regulator (14) located on the ammonia tube (4) or the delivery line (5) and enabling to deliver desired amounts of ammonia from the ammonia tube (4) to the delivery line (5) (FIG. 3). This provides to fill the heat pipe (3) with ammonia controllably.

In another embodiment of the invention, the filling system (1) comprises a control unit (15) to control operation of the valve (6) depending on weight data. This provides to fill the heat pipe (3) with ammonia controllably.

In another embodiment of the invention, the filling system (1) has a control unit (15) to adjust operation of the regulator (14) depending on the temperature information. Depending on the temperature data, ammonia flow rate to be delivered from the regulator (14) to the delivery line (5) is adjusted.

In an embodiment of the invention, the heat pipe (3) is utilized at the space crafts and/or aircrafts for heat transfer. Heat transfer is performed with high precision at space crafts and/or aircrafts. Thanks to the filling system (1), the heat pipe (3) is filled with ammonia in an effective manner with high precision.

The filling system according to the present invention enables to fill the heat pipes (3) with ammonia without disturbing degree of purity of the ammonia gas. Moreover, a single system is able to perform both filling and gas emission operations, thereby reducing the manufacturing costs. In addition, the filling system (1) and method according to the invention is able to fill the heat pipes (3) with ammonia, being in the gas phase at room conditions, in desired amounts, thereby obtaining a heat transfer capacity in the heat pipes (3) at a desired level.

The invention claimed is:

1. A filling system (1) comprising a chamber (2), at least one heat pipe (3) used for heat transfer and extending along the chamber (2), at least one ammonia tube (4) in which pure ammonia is able to be stored at room temperature as saturated vapour, at least one delivery line (5) which enables to deliver ammonia from the ammonia tube (4) to the heat pipe (3) and to which the heat pipe (3) is removably engaged, at least one valve (6) which is located on the delivery line (5) and allows ammonia flow to controlled, at least one detector (7) located on the delivery line (5) and providing seal control, at least one heater (8) to heat the heat pipe (3), and at least one cooler (9) to cool the heat pipe (3), the filling system (1) characterized by comprising at least one additional heater (10) to keep an end of the heat pipe (3) which is connected with the delivery line (5) above a predetermined temperature value.

2. The filling system (1) according to claim 1, characterized in that the filling system (1) has an additional heater (10) which provides heat to an end of the heat pipe (3) which is connected with the delivery line (5), while the heat pipe (3) is cooled.

3. The filling system (1) according to claim 1, characterized in that the filling system (1) has an additional heater (10) to blow hot air.

4. The filling system (1) according to claim 1, characterized in that the filling system (1) comprises a detector (7) to perform seal control while the heat pipe (3) is heated by the heater (8), and a cooler (9) to cool heat pipe (3) in order to liquefy ammonia inside the heat pipe (3) while the heat pipe (3) is filled with ammonia.

5. The filling system (1) according to claim 1, characterized in that the filling system (1) comprises a connection member (11) having a tube-fitting connection feature which enables to connect the heat pipe (3) and the delivery line (5).

6. The filling system (1) according to claim 1, characterized in that the filling system (1) has an additional heater (10) to keep a temperature of the connection member (11) above a predetermined temperature value.

7. The filling system (1) according to claim 1, characterized in that the filling system (1) comprises a cooler (9) to cool the heat pipe (3) gradually from an end of the heat pipe (3) towards the connection of heat pipe (3) and delivery line (5).

8. The filling system (1) according to claim 1, characterized in that the filling system (1) comprises a cooler (9) which is dry ice.

9. The filling system (1) according to claim 1, characterized in that the filling system (1) comprises a valve (6) located on the heat pipe (3) or the delivery line (5) and allowing ammonia transfer or removal into and from the heat pipe (3), and at least one weight measuring device (12) to measure weight of the heat pipe (3).

10. The filling system (1) according to claim 1, characterized in that the filling system (1) comprises at least one heat meter (13) located on the delivery line (5) or the heat pipe (3) and measuring a temperature, and at least one regulator (14) located on the ammonia tube (4) or the delivery line (5) and enabling to deliver desired amounts of ammonia from the ammonia tube (4) to the delivery line (5).

11. The filling system (1) according to claim 1, characterized in that the filling system (1) comprises at least one control unit (15) to control operation of the valve (6) depending on weight data.

12. The filling system (1) according to claim 11, characterized in that the filling system (1) has a control unit (15) to adjust operation of the regulator (14) depending on the temperature information.

13. The filling system (1) according to claim 1, characterized in that the filling system (1) comprises a heat pipe (3) which is utilized at the space crafts and/or aircrafts for heat transfer.

* * * * *